United States Patent [19]

Wilkinson et al.

[11] Patent Number: 4,773,833

[45] Date of Patent: Sep. 27, 1988

[54] HIGH PRESSURE HOMOGENIZER PUMP

[75] Inventors: Bruce S. Wilkinson, Gloucester, Mass.; John M. Bristol, Rye, N.H.

[73] Assignee: APV Gaulin, Inc., Everett, Mass.

[21] Appl. No.: 37,560

[22] Filed: Apr. 13, 1987

[51] Int. Cl.[4] ..... F04B 21/02; F04B 21/08

[52] U.S. Cl. ..... 417/539; 417/454; 417/568; 137/327; 137/454.4; 137/454.6

[58] Field of Search ..... 417/454, 568, 571, 539, 417/559, 269, 533; 137/454.2, 454.4, 454.5, 454.6, 327

[56] References Cited

U.S. PATENT DOCUMENTS

| | | | |
|---|---|---|---|
| 2,250,164 | 7/1941 | Minder | 417/571 |
| 3,119,410 | 1/1964 | Noecker | 417/569 |
| 3,181,474 | 5/1965 | Yohpe | 417/568 |
| 3,185,103 | 5/1965 | Yohpe | 417/568 |
| 3,211,173 | 10/1965 | Mueller et al. | 137/454.5 |
| 4,467,703 | 8/1984 | Redwine et al. | 417/539 X |
| 4,551,077 | 11/1985 | Pacht | 417/539 X |

FOREIGN PATENT DOCUMENTS

| | | | |
|---|---|---|---|
| 2805040 | 8/1979 | Fed. Rep. of Germany | 137/454.5 |

OTHER PUBLICATIONS

G. Vetter and H. Fritsch, "The Calculation and Design of Components with Stress From Pulsating Internal Pressure," *Chemie-Ing.-Tech*, vol. 40, No. 24, 1968, pp. 1215–1223.

Print 2162 of "Bio-Tech Tri-Plex 10 TBS Full Stroke Sterile Seal Design Concept".

APV Schroeder print (in three sheets).

*Primary Examiner*—Carlton R. Croyle
*Assistant Examiner*—ugene L. Szczecina
*Attorney, Agent, or Firm*—Hamilton, Brook, Smith & Reynolds

[57] ABSTRACT

A homogenizer comprises a homogenizing valve mounted to a pump block. Sets of three suction valves and discharge valves are positioned in valve bores in opposite faces of the block. Each of the valve bores has a hemispherical termination. The hemispherical termination of a pump chamber is formed in an adjacent surface of the block and is in communication with the valve bores through oblique conduits. The pump cylinder is formed in a packing box mounted in the block by bolts extending through the block. Integral valve assemblies removable as units are positioned in the valve bores. A pressure sensor is coupled to a discharge manifold through an isolating piston.

25 Claims, 4 Drawing Sheets

HIGH PRESSURE HOMOGENIZER PUMP

BACKGROUND OF THE INVENTION

Homogenization is the breaking down and mixing of the components of an emulsion or dispersion. A major use of homogenizers is to break down and disperse milk fat into the bulk of skim milk. This delays creaming of milk fat globules. Homogenizers are also used to process other emulsions such as silicon oil and to process dispersions such as pigments, antacids and various paper coatings.

In the most widely used type of homogenizer, the emulsion is introduced at high pressure of from 500 psi to 10,000 psi to a central bore within an annular valve seat. The emulsion is forced out through a narrow gap between the valve seat and a valve plate. Through the gap, the emulsion undergoes extremely rapid acceleration as well as an extreme drop in pressure. This violent action through the valve breaks down globules within the emulsion to produce the homogenized product.

The degree of homogenization is a function of the difference between the pressure of the emulsion at the inlet of the valve and the pressure at the outlet. In the past, homogenizers have not typically been required to operate at inlet pressures of greater than 10,000 psi. However, recent applications such as cell disruption have required significantly higher inlet pressures of about 15,000 psi or more.

One available homogenizer system includes a homogenizer valve mounted to the side of a pump block. The pump is a plunger pump in which three plungers operate in parallel at 120° phase shifts relative to each other. The three plungers draw from a common suction manifold and discharge into a common discharge manifold which delivers the high pressure fluid to the homogenizer valve. The suction and discharge manifolds are cross bores which extend parallel to opposite faces of the block. Three valve bores drilled through one of those faces join the two manifolds, and a one-way valve assembly is positioned at each end of each of those valve bores. Another set of three bores is drilled through an adjacent face of the block to form pump chambers. Each pump chamber intersects each valve bore at a 90° angle. Each plunger reciprocates in a pump chamber to draw fluid through a suction valve from the suction manifold and discharge that fluid at higher pressure through a discharge valve into the discharge manifold.

DISCLOSURE OF THE INVENTION

With attempts to obtain higher pressures, fractures have occurred in cylinder walls of the pump. Such fractures have occurred at the intersections of the pump chamber bore and valve bores. In accordance with the present invention, the stress which has resulted in those fractures is minimized by providing each pump chamber with a hemispherical termination. Similarly, separate suction and discharge valve bores with hemispherical terminations are formed in the pump block. The valve bores and the pump chamber are joined by conduits which radially intersect at the hemispherical terminations of the bores.

In a preferred system, the cylinder of the pump chamber is formed in a packing box which is fixed to the main block, and the termination of the pump chamber is formed as a hemispherical cup in the surface of the block. The suction bore and discharge bore are formed in opposite faces of the block along a line normal to the pump cylinder. The conduits between the valve bores and the pump chamber are formed through the hemispherical termination of the pump chamber at oblique angles relative to the pump chamber and to the discharge and suction valve bores. Three suction valve bores are in communication with each other through a suction cross-bore, and three discharge valve bores are in communication with each other through a discharge cross bore.

In many applications, the valve assemblies and plunger assembly must be readily removed for cleaning. Preferably, the packing box is mounted to the block by bolts extending through to the opposite face of the block and a plunger from the packing box is removably coupled to a drive shaft. The packing box can thus be easily removed. To prevent any threaded coupling in the packing box which would result in additional stress, the packing and a bearing are retained within the packing box by an inwardly extending flange which is unitary with the packing box. The packing and bearing are pressed axially against a packing box seat which is retained by the flange. The seat is of a hard material which can be struck, after the packing box has been removed from the system, to drive the packing, bearing and seat from the packing box. The entire assembly is thus readily disassembled for cleaning.

Each of the suction and discharge valves is only accessible from a single end of the respective valve bore. Each valve bore is intersected by a manifold cross-bore at a region between an outer portion of the bore and an inner portion of a lesser diameter. A seal is provided on the corresponding portions of each valve assembly.

In each discharge valve, a ball valve is inserted in a central bore of a valve seat along with a valve stop having a tapered nose and seal. A plug is loosely positioned within a threaded portion of the central bore to retain the valve stop. To remove the valve assembly, the plug is removed as by a magnetic tool, and the remainder of the assembly is removed as an integral unit with a threaded puller.

Similar suction valve assemblies are provided except that the ball valves are not positioned within the unitary assembly. Rather, the valve stop is loosely placed at the end of the valve bore and is followed by the ball and valve seat. Again, the valve seat may be removed by a threaded puller.

Preferably, a pressure sensor is coupled to the discharge cross bore through a piston element which provides double seal isolation.

BRIEF DESCRIPTION OF THE DRAWINGS

The foregoing and other objects, features and advantages of the invention will be apparent from the following more particular description of a preferred embodiment of the invention, as illustrated in the accompanying drawings in which like reference characters refer to the same parts throughout the different views. The drawings are not necessarily to scale, emphasis instead being placed upon illustrating the principles of the invention.

DESCRIPTION OF A PREFERRED EMBODIMENT

Figure 1:
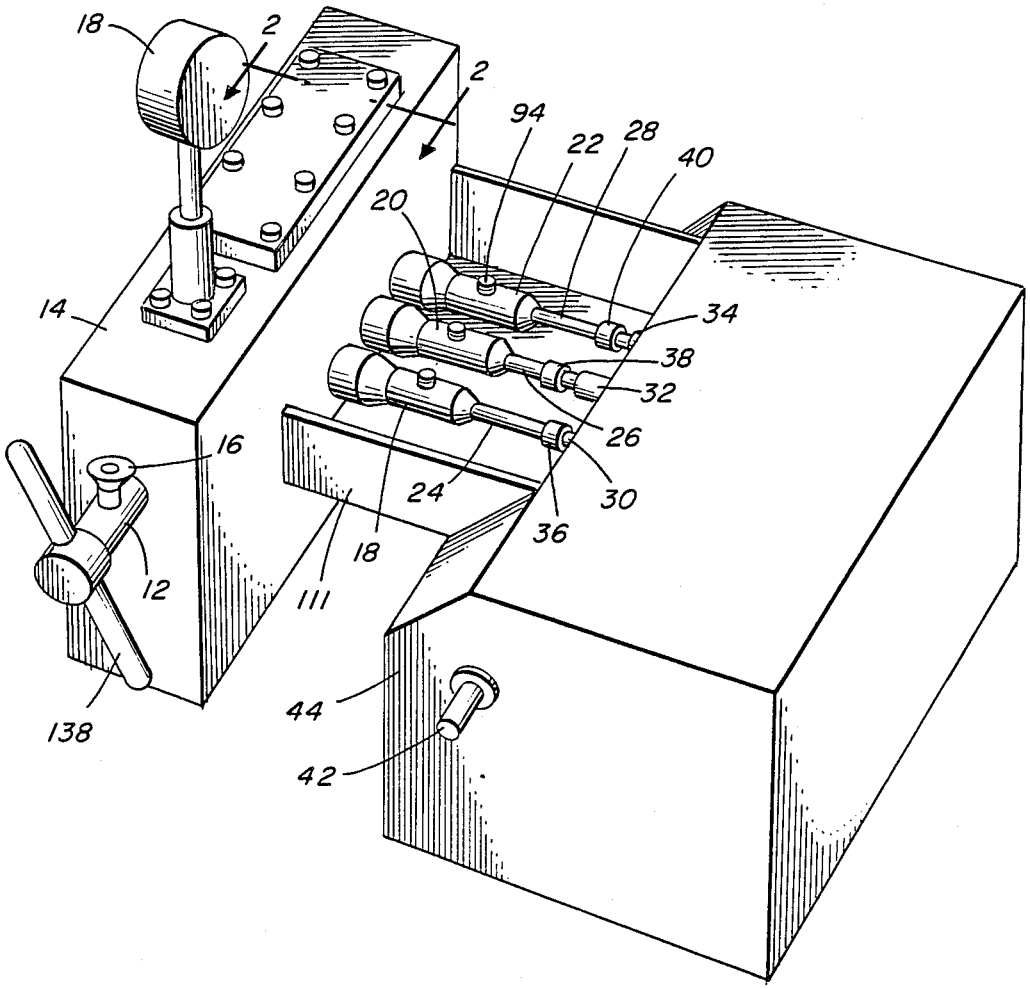
FIG. 1 is a perspective view of a homogenizer valve and pump assembly embodying the present invention.

FIG. 1 is a perspective view of a homogenizer system embodying the present invention. The view is from a direction which a user would consider to be the rear of the system to show the plunger drive. A conventional homogenizer valve 12 is mounted to a pump block 14. The valve receives pressurized fluid from the pump, and the homogenized fluid is discharged through the flanged port 16. Pressure of the fluid leading to the homogenizer valve can be monitored by a pressure gauge I8 mounted to the block.

The pump comprises three plunger pumps which operate, in parallel, 120° out of phase with each other. Each pump unit includes a cylinder packing box 18, 20, 22 mounted to the block 14. A plunger 24, 26, 28 is coupled to a respective drive shaft 30, 32, 34 by means of a compression coupling 36, 38, 40. The drive shafts are driven through an eccentric shaft 42 located in box 44 by an electric motor (not shown). A set of three suction valves are accessed through the bottom of the block 14, and a set of three discharge valves are accessed through the top of the block by removal of a plate 44.

Figure 2:
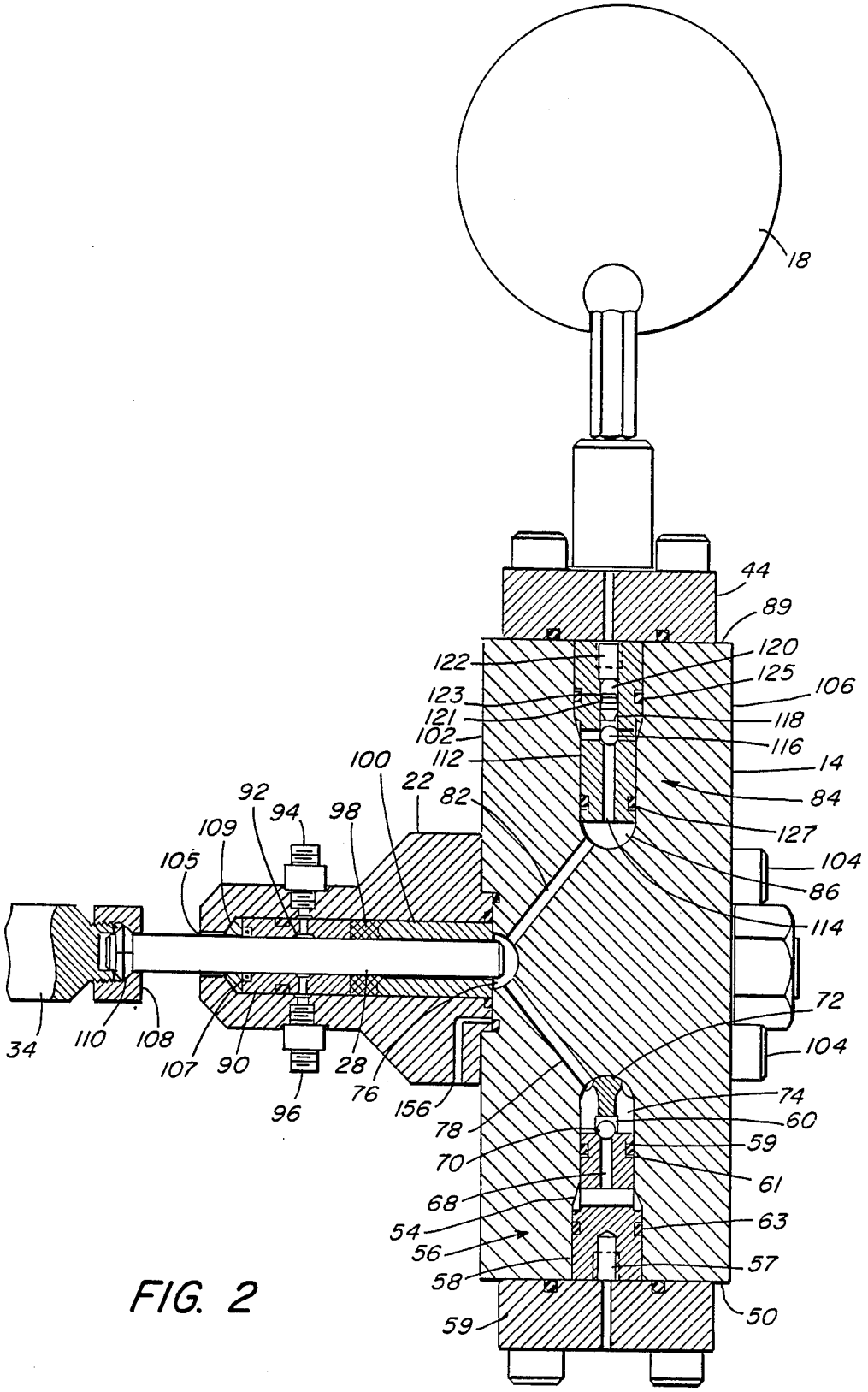
FIG. 2 is a cross-sectional view of the pump of FIG. 1 taken along line 2—2.
Figure 3:
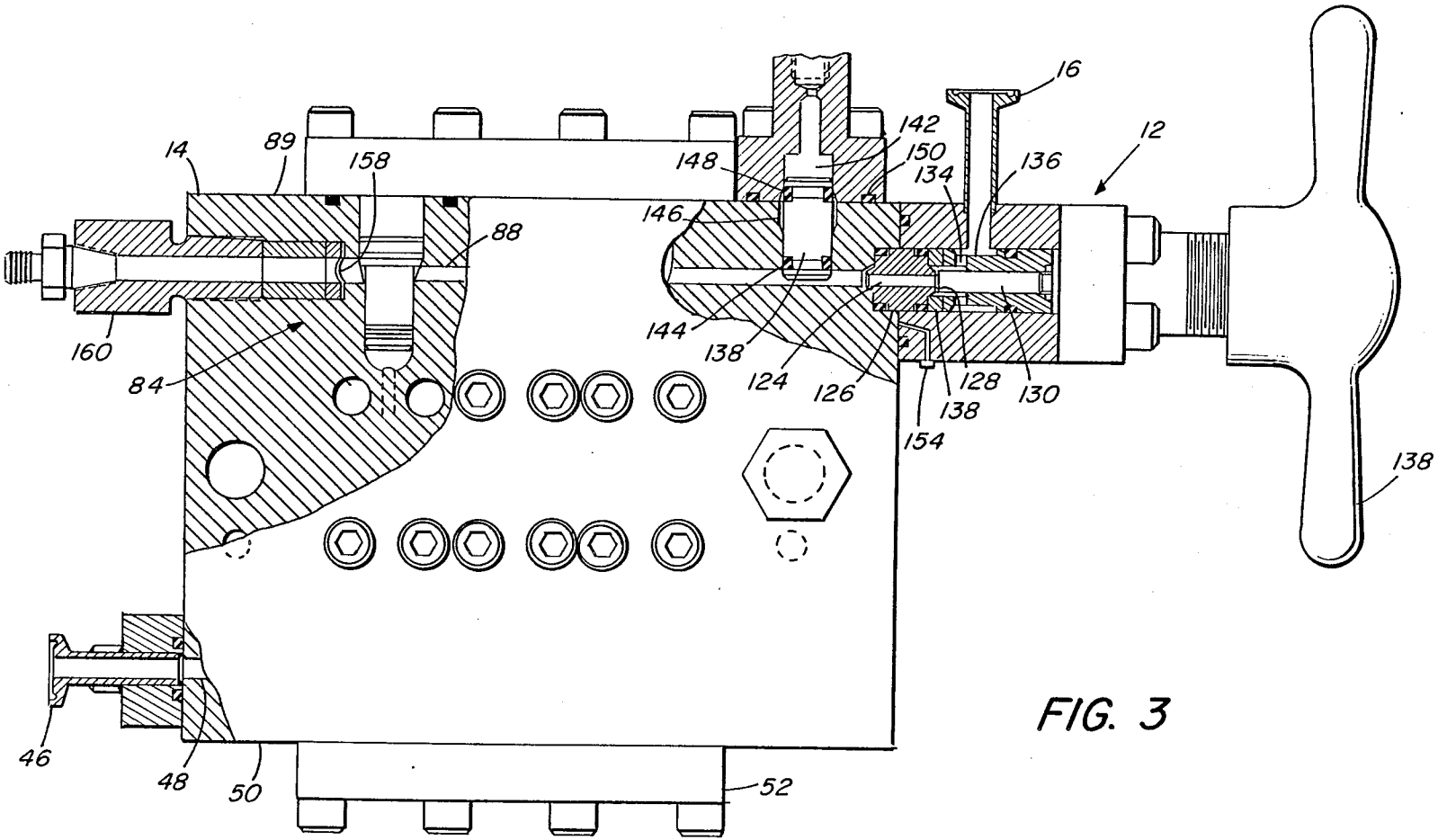
FIG. 3 is an elevational view, partially broken away, of the system of FIG. 1 as viewed from the rear of FIG. 1.
Figure 4:
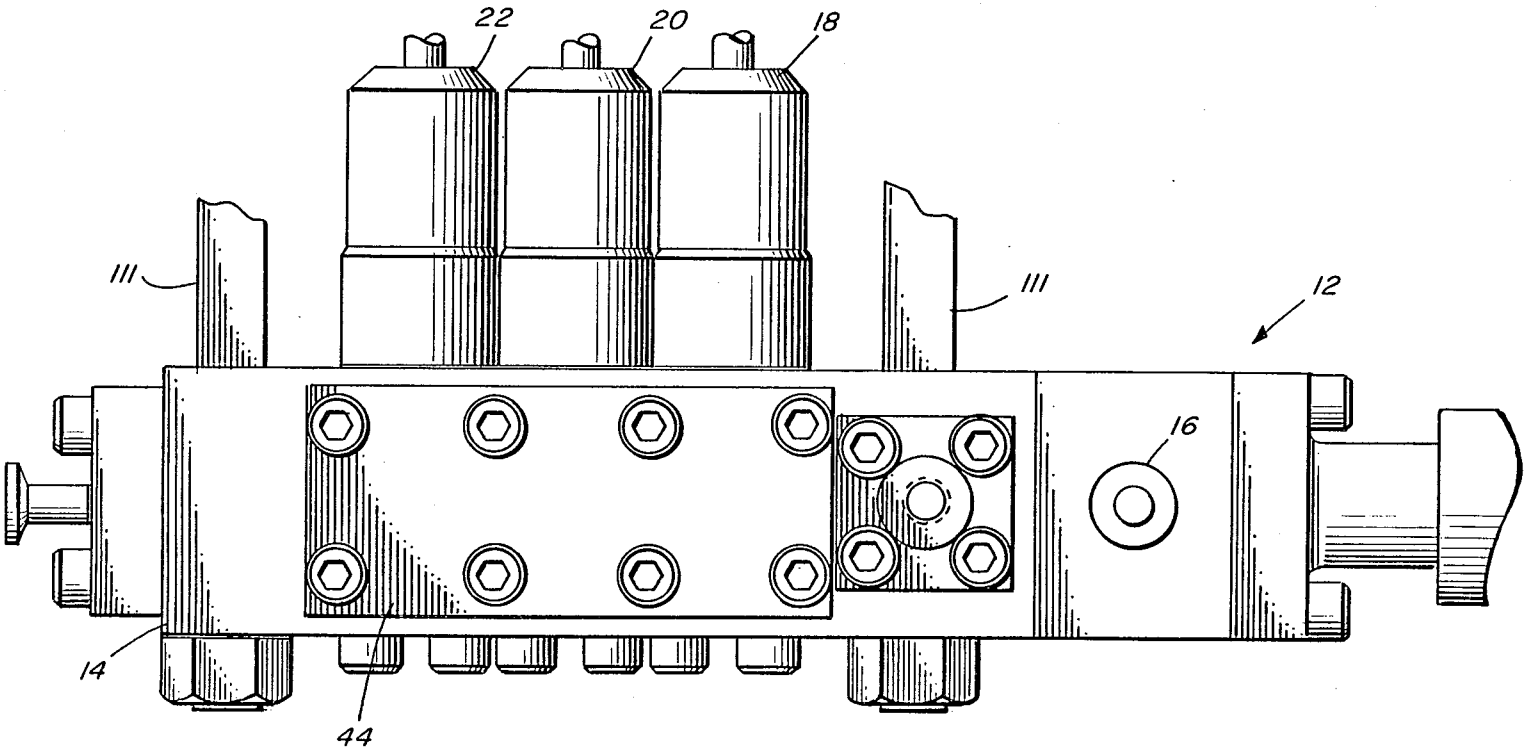
FIG. 4 is a top view of the system of FIG. 1.

One stage of the pump is illustrated in cross section in FIG. 2. As shown in FIG. 3, fluid is drawn into the pump through a flanged port 46 into a manifold 48. The manifold is a cross-bore extending through the block parallel to the bottom face 50. The manifold 48 extends through a set of three suction valve bores covered by a plate 52. One of those suction valve bores 54 is illustrated in FIG. 2. A suction valve assembly 56 is positioned in each bore.

As shown in FIG. 2, the suction valve communicates with a pump chamber 76 through a suction conduit 78. A plunger 28 drives the fluid from the chamber 76 through a discharge conduit 82 to a discharge valve assembly 84. The discharge valve assembly is positioned in a valve bore 86 which communicates with a discharge manifold 88. The discharge manifold 88 is also a cross-bore and is parallel to the upper face 89 of the block 14. There are three discharge valves in communication with the manifold 88 and covered by the access plate 44.

Studies have shown that the fractures in failed pumps have occurred where the valve bores intersected the pump chambers. Other studies have shown that stresses between interconnected bores can be minimized by intersecting one bore with another at a hemispherical termination of the other. In accordance with the present invention, each of the pump chamber and the suction and discharge valve bores have hemispherical terminations. The conduits 78 and 82 extend into the respective valve bores and into the pump chamber radially through the hemispherical centers.

Only the termination of the pump chamber is formed in the block 14. This allows the oblique conduits 78 and 82 to be readily drilled from the termination 76. The cylinder of the pump chamber is formed in a cylinder packing box 22 mounted to the block 14. The plunger 28 is driven in a bearing 90 which is cooled and lubricated by water passed through an annulus 92 from a port 94 to a discharge port 96. A dynamic seal is maintained by packing 98 which is retained by a stainless steel ring 100. The ring 100 rests against the surface 102 of the block 14 and is pressed into the packing as the packing box 22 is bolted onto the block.

The packing box 22 is bolted onto the block by a set of four bolts 104 from the opposite face 106 of the block. The plunger 28 is coupled to the drive shaft 34 by a compression fitting which includes a nut 108 threaded onto the shaft 34 to compress a ferrule 110. This arrangement allows for alignment of the cylinder packing box 22 to the plunger within the clearance dimension of the bolt and bolt holes. The plunger and packing box can be readily removed for cleaning by simply disconnecting the compression fitting 108 and loosening the bolts I04 from the front of the block 14. The heavy block 14 would remain fixed to its supports 111. The plunger can then be slipped from the packing box. The bearing 90, packing 98 and ring 100 can then be removed from the packing box 22 by placing a tool against a packing box seat 109 of and striking the tool. The hard packing box seat 109 protects the softer bearing material and the seal 107.

Typical packing boxes have a nut fitted to the end of the packing box to retain the bearing. The threads of such a nut are stress points which might lead to fracture in a high pressure pump. In the present system, the packing and bearing are retained by an internal flange 105 of the packing box and are inserted and removed through the end of the box which is fixed to the block 14.

The valve assembly 56 positioned in the valve bore 54 is a ball check valve. The valve assembly, which is removable as a single unit, comprises a valve seat 58 having a central channel 68 in communication with the manifold 48. A ball 70 closes the channel 68 when positive back pressure is applied. A member 72 serves as a ball guide and stop. The valve guide has slots 74 formed therein to provide fluid communicaion from the central bore 60 to the volume at the end of the valve bore 72. Those slots are sufficiently narrow to retain the ball within the valve guide. The suction valve assemblies can be readily removed for cleaning by removing the plate 59 and withdrawing the unitary valve seat 58 with a threaded puller joined at the threaded bore 57. The ball 70 will fall with the valve seat, and the valve guide and stop 72, which is loosely retained in the valve bore without a seal, can be readily removed by a magnetic tool. Both the valve seat and the valve bore are of two diameters to allow the high pressure seal 59 to pass clear of the manifold cross-bore 48 prior to being compressed in the lesser diameter portion of the bore. A back-up ring 61 is provided on the low pressure side of the high pressure seal. An additional seal 63 is provided in the larger diameter portion of the valve seat.

Each discharge valve assembly comprises a valve seat 112 having a center channel 114 in communication with the hemispherical termination of the valve bore. A ball 116 is guided within a bore 118 above th valve seat. A valve stop 120 is positioned in bore 118 of the valve seat and is retained by a removable plug 122. A seal 121 is positioned about the valve stop and is backed by a back-up ring 123. The valve stop has a tapered nose to allow for ready positioning of the seal about the valve stop with minimum stretching of the seal and back-up ring. The seal prevents the valve stop from being readily removed; thus, it is spaced from the plate 44 by a loosely fitting plug 122 which may be removed from the threaded portion of the bore 118 by a magnetic tool.

After the removal of that plug, the entire discharge valve assembly may be removed with a threaded puller as a unit. The ball valve and valve stop can then be pushed out of the bore 118 by a rod. As with the suction valves, each discharge valve seat is of two diameters with respective seals 125 and 127. Each of those seals is provided with a back-up ring to prevent extrusion of the seal.

As shown in FIG. 3, pressurized fluid from the three discharge valves is directed by the manifold 88 to the homogenizing valve 12. Pressurized fluid is introduced into the homogenizing valve through a conduit 124 in the valve seat 126. The fluid is directed radially outward through a valve slit 128 formed between the valve seat 126 and a valve member 130. An impact ring 132 surrounds the slit and directs the homogenized fluid axially to ports 134, an annulus 136 and the discharge port 16.

The pump is a constant volume pump, and pressure is maintained by adjusting the gap of the homogenizing valve slit. That adjustment is made by an actuator wheel 138. Automatic controls may also be provided, as by a hydraulic actuator.

The pressure gauge 18 is not coupled directly to the discharge manifold 88 but is isolated by a piston element 138. The piston is forced against hydraulic fluid, and the pressure is transmitted through the hydraulic fluid in the chamber 142 to the gauge. The piston 138 allows for venting of leakage and prevents contamination of the gauge from any noxious fluids handled by the system or contamination of the pumped fluid by gauge fluid.

Sealing of noxious fluids is enhanced by double sealing through the system. For example, any leakage past the seal 144 on the isolation piston is captured in an annulus 146 which is saled by further seals 148 and 150. Any fluid collected in the annulus 146 may be carried off through a vent port in the block 14 (not shown). Similarly, double sealing is provided with a vent port 154 at the coupling of the homogenizer to the block 14, and double sealing with a vent port 156 is provided at the coupling of the cylinder packing box 22 to the block 14. Further, even where venting is not provided, an aerosol effect is avoided by causing all leakage past the first seal to follow a sharp turn before reaching the atmosphere.

Any over pressure in the discharge manifold may be released by a rupture valve 158 which vents through a safety relief port 160.

While this invention has been particularly shown and described with references to a preferred embodiment thereof, it will be understood by those skilled in the art that various changes in form and details may be made therein without departing from the spirit and scope of the invention as defined by the appended claims.

We claim:

1. A pump comprising:

a block;

a pump chamber having a hemispherical termination formed through a first surface of the block along a pump axis;

a suction valve bore having a hemispherical termination formed through a second surface of the block along a suction axis angled relative to the pump axis;

a one-way suction valve assembly positioned in the suction valve bore;

a discharge valve bore having a hemispherical termination formed through a third surface of the block along a discharge axis angled relative to the pump axis;

a one-way discharge valve assembly in the discharge valve bore;

a suction conduit radially intersecting the hemispherical termination of the suction valve bore and the hemispherical termination of the pump chamber; and a discharge conduit radially intersecting the hemispherical termination of the discharge valve bore and the hemispherical termination of the pump chamber.

2. A pump as claimed in claim 1 wherein the discharge valve assembly is a unit comprising a valve stop, a ball valve, and a valve seat removable as an integral unit.

3. A pump as claimed in claim 2 wherein the discharge valve assembly comprises a valve seat having a central bore therein through which a ball valve is positioned, a valve stop sealed within the central bore and a plug positioned within a threaded portion of the bore to retain the valve stop.

4. A pump as claimed in claim 3 wherein the valve stop has a tapered nose.

5. A pump as claimed in claim 1 wherein the suction valve comprises a valve stop loosely retained at the end of the suction valve bore, a ball valve, and a valve seat for retaining the ball valve adjacent to the valve seat, the valve seat comprising a central bore for providing fluid communication to the ball valve and a separate threaded bore sealed from the central bore for allowing removal of the valve seat.

6. A pump as claimed in claim 1 wherein the pump chamber comprises a cylinder formed in a packing box fixed to the block, and the termination of the pump chamber is formed as a hemispherical cup in the surface of the block.

7. A pump as claimed in claim 6 wherein the packing box comprises an inwardly directed flange, for retaining a bearing and packing, and a seat between the bearing and flange to allow for removal of the bearing and packing by striking the seat.

8. A pump as claimed in claim 6 wherein the suction conduit and discharge conduit are formed at oblique angles relative to the pump chamber and to the discharge and suction valve bores.

9. A pump as claimed in claim 6 wherein the cylinder casing is bolted to the block by means of bolts passing through the block and a plunger within the cylinder is removably coupled to a drive shaft.

10. A pump as claimed in claim 1 comprising a set of three pump chambers spaced along the first surface, a set of three suction valve bores spaced along the second surface and a set of three discharge valve bores spaced along the third surface with the suction valve bores in communication with each other through a suction cross-bore and the discharge valve bores in communication with each other through a discharge cross-bore.

11. A pump as claimed in claim 1 wherein the block is rectangular in cross section with the second and third surfaces parallel to each other and normal to the first surface, the suction valve bore and discharge valve bore are coaxial along an axis normal to the pump axis, and the suction conduit and discharge conduit are formed at oblique angles relative to the pump chamber and to the discharge and suction valve bores.

12. A pump as claimed in claim 1 further comprising a homogenizing valve in communication with the discharge bore.

13. A pump as claimed in claim 1 further comprising a pressure sensor coupled to the discharge valve bore through an isolation piston.

14. A pump comprising:

a block:

a suction manifold extending through the block;

a set of suction valve bores, each having a hemispherical termination, formed through the block to intersect the suction manifold;

a one-way suction valve assembly positioned in each of the suction valve bores;

a discharge manifold extending through the block;

a set of discharge valve bores, each having a hemispherical termination, formed through a surface of the block opposite to the suction valve bores to intersect with the discharge manifold;

a one-way discharge assembly positioned in each of the discharge valve bores;

a set of pump chambers, each comprising a cylinder formed in a packing box fixed to the block, the cylinders extending at right angles to the suction and discharge valve bores, the termination of each cylinder being a hemispherical cup in the surface of the block, each packing box being mounted to the block by means of bolts extending through the block;

a suction conduit radially intersecting the hemispherical termination of each suction valve bore and the hemispherical termination of a corresponding pump chamber at oblique angles relative to the pump chamber and to the suction valve bore; and a discharge conduit radially intersecting the hemispherical termination of each discharge valve bore and the hemispherical termination of a corresponding pump chamber and extending at oblique angles relative to the pump chamber and to the discharge valve bore.

15. A pump as claimed in claim 14 wherein each discharge valve assembly is a unit comprising a valve stop, a ball valve, and a valve seat removable as an integral unit.

16. A pump as claimed in claim 15 wherein each valve assembly comprises a valve seat having a central bore therein through which a ball valve is positioned, a valve stop sealed within the central bore and a plug positioned within a threaded portion of the bore to retain the valve stop.

17. A pump as claimed in claim 16 wherein the valve stop has a tapered nose.

18. A pump as claimed in claim 14 wherein the suction valve comprises a valve stop loosely retained at the end of the suction valve bore, a ball valve, and a valve seat for retaining the ball valve adjacent to the valve seat, the valve seat comprising a central bore for providing fluid communication to the ball valve and a separate threaded bore sealed from the central bore for allowing removal of the valve seat.

19. A pump as claimed in claim 18 wherein the packing box comprises an inwardly directed flange, for retaining a bearing and packing, and a seat between the bearing and flange to allow for removal of the bearing and packing by striking the seat.

20. A homogenizer comprising:

a block;

a suction manifold extending through the block;

a set of suction valve bores, each having a hemispherical termination, formed through the block to intersect the suction manifold;

a one-way suction valve assembly positioned in each of the suction valve bores;

a discharge manifold extending through the block;

a set of discharge valve bores, each having a hemispherical termination, formed through a surface of the block opposite to the suction valve bores to intersect with the discharge manifold;

a one-way discharge assembly positioned in each of the discharge valve bores;

a set of pump chambers each comprising a cylinder formed in a packing box fixed to the block, the cylinders extending at right angles to the suction and discharge valve bores, the termination of each cylinder being a hemispherical cup in the surface of the block, each cylinder casing being mounted to the block by means of bolts extending through the block;

a suction conduit radially intersecting the hemispherical termination of each suction valve bore and the hemispherical termination of a corresponding pump chamber at oblique angles relative to the pump chamber and to the suction valve bore;

a discharge conduit radially intersecting the hemispherical termination of each discharge valve bore and the hemispherical termination of a corresponding pump chamber and extending at oblique angles relative to the pump chamber and to the discharge valve bores; and a homogenizing valve mounted to the block in communication with the discharge manifold.

21. A pump as claimed in claim 20 wherein each discharge valve assembly is a unit comprising a valve stop, a ball valve, and a valve seat removable as an integral unit.

22. A pump as claimed in claim 21 wherein each valve assembly comprises a valve seat having a central bore therein through which a ball valve is positioned, a valve stop sealed within the central bore and a plug positioned within a threaded portion of the bore to retain the valve stop.

23. A pump as claimed in claim 22 wherein the valve stop has a tapered nose.

24. A pump as claimed in claim 20 wherein the suction valve comprises a valve stop loosely retained at the end of the suction valve bore, a ball valve, and a valve seat for retaining the ball valve adjacent to the valve seat, the valve seat comprising a central bore for providing fluid communication to the ball valve and a separate threaded bore sealed from the central bore for allowing removal of the valve seat.

25. A pump as claimed in claim 24 wherein the packing box comprising an inwardly directed flange, for retaining a bearing and packing, and a seat between the bearing and flange to allow for removal of the bearing and packing by striking the seat.

* * * * *